US010895172B2

(12) United States Patent
Juretzek et al.

(10) Patent No.: US 10,895,172 B2
(45) Date of Patent: Jan. 19, 2021

(54) PRESERVATION METHOD

(71) Applicant: Siemens Aktiengesellschaft, Munich (DE)

(72) Inventors: Uwe Juretzek, Erlangen (DE); Michael Rziha, Erlangen (DE); Edwin Gobrecht, Ratingen (DE); Michael Schöttler, Erlangen (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 16/496,186

(22) PCT Filed: Apr. 10, 2018

(86) PCT No.: PCT/EP2018/059155

§ 371 (c)(1),
(2) Date: Sep. 20, 2019

(87) PCT Pub. No.: WO2018/189176

PCT Pub. Date: Oct. 18, 2018

(65) Prior Publication Data

US 2020/0149435 A1 May 14, 2020

(30) Foreign Application Priority Data

Apr. 11, 2017 (DE) ..... 10 2017 206 196

(51) Int. Cl.
*F01K 13/02* (2006.01)
*F01D 11/04* (2006.01)
(Continued)

(52) U.S. Cl.
CPC ..... *F01K 13/02* (2013.01); *F01D 11/04* (2013.01); *F01D 21/00* (2013.01); *F01D 25/00* (2013.01); *F01K 9/00* (2013.01)

(58) Field of Classification Search
CPC . F01K 3/22; F01K 13/02; F01K 9/006; F01K 9/00; F01D 11/04; F01D 11/06;
(Continued)

(56) References Cited

U.S. PATENT DOCUMENTS 3,584,973 A * 6/1971 Lambiris ..... F01D 25/22 417/13
4,519,207 A * 5/1985 Okabe ..... F01K 23/16 122/7 R
(Continued)

FOREIGN PATENT DOCUMENTS

DE 4439516 A1 5/1996
DE 102014210221 A1 12/2015
(Continued)

OTHER PUBLICATIONS

PCT International Search Report and Written Opinion of International Searching Authority dated Dec. 9, 2018 corresponding to PCT Application No. PCT/EP201 8/059155 filed Oct. 4, 2018.

*Primary Examiner* — Mark A Laurenzi
*Assistant Examiner* — Mickey H France

(57) ABSTRACT

A power plant and method for preserving a power plant, the power plant having a steam turbine with a shaft, further including a condenser mounted downstream of the steam turbine in the direction of flow of the steam, a vacuum pump mounted downstream of the condenser, a compressed steam system with shaft seals, and a compressed steam supply line extending into the shaft seals; a first nitrogen line extends into the condenser, and a second nitrogen line as well as a recirculation line that branches off the vacuum pump extend into the compressed steam supply line.

14 Claims, 2 Drawing Sheets

(51) Int. Cl.
*F01D 21/00* (2006.01)
*F01D 25/00* (2006.01)
*F01K 9/00* (2006.01)

(58) Field of Classification Search
CPC ..... F01D 19/00; F01D 19/02; F01D 21/00; F01D 21/12; F01D 21/14; F01D 21/20; F01D 25/00; F28B 9/10
USPC ..... 60/646, 652, 657, 659
See application file for complete search history.

(56) References Cited

U.S. PATENT DOCUMENTS 4,732,004 A * 3/1988 Brand ..... F28B 9/10 60/646
4,905,474 A * 3/1990 Larinoff ..... F28B 1/06 165/111
5,694,772 A * 12/1997 Weinberg ..... F03G 7/04 60/641.2
5,921,085 A * 7/1999 Kawano ..... F28B 9/10 60/646
6,588,499 B1 * 7/2003 Fahlsing ..... F28B 1/06 165/111
8,820,078 B1 * 9/2014 Duffy ..... F22B 1/00 60/646
2004/0065089 A1 4/2004 Liebig
2005/0034445 A1 * 2/2005 Radovich ..... F01K 23/10 60/39.182
2005/0109032 A1 * 5/2005 Harpster ..... F28B 1/02 60/685
2005/0198961 A1 * 9/2005 Shirk ..... F03G 6/005 60/670
2006/0010869 A1 * 1/2006 Blangetti ..... F28B 9/10 60/646
2009/0056303 A1 * 3/2009 Araki ..... F04D 29/5846 60/39.53
2009/0077979 A1 * 3/2009 Masaki ..... F01D 25/007 60/806
2013/0074499 A1 * 3/2013 Palmer ..... F01K 19/04 60/645
2014/0238023 A1 * 8/2014 Hatama ..... F01K 19/00 60/671
2014/0331671 A1 * 11/2014 Lenherr ..... F28B 1/02 60/645
2017/0183977 A1 6/2017 Brune et al.
2018/0328584 A1 * 11/2018 Eckert ..... F23C 99/00
2019/0072006 A1 * 3/2019 Duffy ..... F01K 13/02
2019/0170020 A1 * 6/2019 Zhang ..... G21C 1/04

FOREIGN PATENT DOCUMENTS

DE 102014210225 A1 12/2015
DE 102014225711 A1 6/2016
EP 2995785 A1 3/2016
JP H04119301 U 10/1992
JP H1162619 A 3/1999
JP 2003293707 A 10/2003
JP 2016098957 A 5/2016
WO 02081870 A1 10/2002

* cited by examiner

PRESERVATION METHOD

CROSS REFERENCE TO RELATED APPLICATIONS

This application is the US National Stage of International Application No. PCT/EP2018/059155 filed Apr. 10, 2018, and claims the benefit thereof. The International Application claims the benefit of German Application No. DE 10 2017 206 196.0 filed Apr. 11, 2017. All of the applications are incorporated by reference herein in their entirety.

FIELD OF INVENTION

The invention relates to a power plant and to a method for preserving a power plant.

BACKGROUND OF INVENTION

In the case of a power plant with steam turbine, the steam turbine and condenser have to be preserved if shut down for extended periods in order to limit corrosion. At the same time, there is a requirement, with thermal power stations with water-steam circuits, to be able to start them up again quickly after extended out-of-service periods and to achieve chemical steam purity rapidly during start-up, so as to be able to bring the steam turbine back into operation as soon as possible.

Hitherto, with extended out-of-service periods the vacuum was broken, i.e. steam turbine and condenser were filled with ambient air. The ambient air thus contained in steam turbine and condenser was dried by means of dryers to such an extent that corrosion was sufficiently constrained by moisture being largely absent. A critical point in this connection is the condensate collection tank, from which the condensate is either completely drained off or at least the filling level is reduced. This makes renewed start-up more difficult. Furthermore, breaking the vacuum means that "contamination" is also introduced into the steam turbine and the condenser via the ambient air, such that the necessary steam purity on renewed start-up is correspondingly difficult to achieve and the start-up process takes a correspondingly longer time.

Corrosion may be prevented either by the absence of moisture (the most common approach hitherto in relation to steam turbine and condenser) or of oxygen. For example, nitrogen is these days conventionally used for corrosion prevention and preservation in the steam-conveying area of the boiler and in the steam line area.

SUMMARY OF INVENTION

An object of the invention is to provide a power plant with which a preservation method is possible which is advantageous both with regard to efficacy and cost-efficiency and with regard to the capacity for rapid start-up of the power plant. A further object of the invention is to indicate a corresponding preservation method.

The invention achieves the object directed at a power plant by providing that, in such a power plant comprising a steam turbine with a shaft, a condenser connected downstream of the steam turbine in the direction of steam flow, a vacuum pump connected downstream of the condenser, a compressed steam system with shaft seals and a compressed steam supply line leading into the shaft seals, a first nitrogen line leads into the condenser and a second nitrogen line and a recirculation line branching off from the vacuum pump lead into the compressed steam supply line.

As a result of the possibility of introducing nitrogen into the compressed steam system and additionally also directly into the condenser, the steam turbine/condenser may be brought to a low nitrogen overpressure (a few mbar) during shutdown into the preserved state. The nitrogen requirements may be kept comparatively low by way of the recirculation line.

The use of nitrogen for preserving the steam turbine as an alternative to drying leads to reduced water consumption—the condensate in the condensate collection tank is no longer discarded, so resulting in a reduced quantity of waste water.

In general, the dryer operating costs are dispensed with.

In one advantageous embodiment of the invention, the shaft seals comprise sealing steam chambers and exhaust steam chambers, wherein the compressed steam supply line leads into the sealing steam chambers and the exhaust steam chambers are connected with an exhaust steam fan for drawing off air penetrating into the shaft seals and a substream of the steam from the sealing steam chambers and feeding them to an exhaust steam condenser. By way of this arrangement, in the case of preservation with nitrogen the nitrogen may also be collected or drawn off in controlled manner and optionally sent for reuse. Nitrogen, which is required or arises to an appreciable extent in the case of a shutdown, preserved plant, may in particular be recovered.

In a further advantageous embodiment, an electrical superheater is connected into the compressed steam supply line and the nitrogen line leads into the compressed steam supply line upstream of the superheater. If necessary, preheating/keeping warm of the steam turbine may be assisted by heating of the nitrogen via the electrical superheater (actually an auxiliary steam superheater) present in the compressed steam system.

The object directed at a method is achieved by a method for preserving a power plant comprising a steam turbine, a condenser connected downstream of the steam turbine, a vacuum pump connected downstream of the condenser and a compressed steam system, wherein, on shutdown of the steam turbine into a preserved state, nitrogen is introduced into the compressed steam system and into the condenser, and the steam turbine and the condenser are brought to nitrogen overpressure and the vacuum pump is switched off, wherein on start-up of the steam turbine nitrogen is branched off at the exhaust air of the vacuum pump and fed back to the compressed steam system.

It is advantageous for nitrogen to be introduced into a compressed steam supply line of the compressed steam system upstream of an electrical superheater. The electrical superheater in the compressed steam system ensures that the nitrogen fed in via the compressed steam system has sufficiently high temperatures for the shaft compressed steam supply.

By earlier change-over to nitrogen supply, the compressed steam requirements may be reduced after shutdown, which leaves more heat in the boiler and thus keeps the latter capable of a hot or warm start for longer.

It is therefore convenient for nitrogen to be fed jointly with steam into the compressed steam supply line (8) on shutdown of the power plant (1) as soon as it is possible to break the vacuum.

With regard to dealing economically with nitrogen, it is advantageous, after shutdown of the steam turbine, once a nitrogen overpressure has been reached in the steam turbine and in the condenser, for the nitrogen supply of the compressed steam system to be taken out of operation during the preservation phase. Once a slight nitrogen overpressure has been reached in the steam turbine or condenser, the overpressure may be maintained by nitrogen backfeed at the condenser. This procedure reduces nitrogen consumption.

Attention has in the process to be paid to temperature fluctuations. In particular, it is advantageous for a nitrogen pressure to be increased in the steam turbine or in the condenser prior to an expected temperature change, in particular cooling, in the steam turbine or in the condenser. Otherwise, ambient air may unfavorably be drawn into the steam turbine or the condenser. Such a temperature fluctuation and associated pressure fluctuation in steam turbine or condenser may be caused, for example, by operation of the main cooling water system during preservation. Such circulation of the cooling water over extended shutdowns is necessary from time to time from a chemical/biological standpoint.

To avoid these problems, a corresponding nitrogen pressure control strategy is necessary which also takes account of changes in operating state, e.g. the nitrogen pressure may be raised slightly prior to switching on of the cooling water pumps. Regular checking of the residual oxygen in the preserved volume is also necessary.

Advantageously, on start-up of the power plant, as long as sufficient compressed steam is not present, nitrogen is backfed continuously via the compressed steam system. This proceeds in particular during condenser evacuation for sealing of the steam turbine shaft seal. In this way, ambient air is prevented from flowing in behind into the steam turbine and consequently contamination of the water-steam circuit is prevented. A compressed steam supply independent of the waste-heat steam generator is thus not needed, i.e. it could optionally be possible to save on a separate auxiliary steam generator. This also leads to energy savings.

It is very particularly advantageous for nitrogen from the condenser to be recirculated into the compressed steam system for start-up of the power plant, specifically once air in a recirculation line from the condenser to the compressed steam system has been expelled and once a sufficiently reduced pressure has been achieved in the condenser to allow steam diverting stations to be opened. Sufficiently reduced pressure typically means 600 mbar.

Furthermore, it is advantageous for heating or keeping warm of the steam turbine to be assisted by heating of the nitrogen via an electrical superheater arranged in the auxiliary steam system.

It is convenient for the nitrogen-enriched exhaust air from the exhaust steam chambers to be compressed and made available as input air to a nitrogen generator.

Furthermore, it is convenient for a comparatively small quantity of high purity nitrogen to be provided for preservation during the shutdown procedure and the out-of-service period and for a comparatively larger quantity of less pure nitrogen to be provided per unit time for start-up.

Advantageously, the exhaust steam system is in operation at least for a time during deliberate filling of the condenser and the steam turbine with nitrogen.

The invention results in numerous advantages. For example, in addition to markedly improved preservation compared with the current (dryer-based) system (e.g. greatly reduced corrosion in the condensate collection tank), the invention also enables cost savings to be made (in relation to capital and operating costs) while at the same time ensuring a maximally reduced start-up time from the extended out-of-service period, this being achieved without the need for any external auxiliary steam source. The preparation time to actual starting time is reduced for example relative to the prior art in that the condensate collection tank is already filled or it is not necessary to wait for compressed steam to be provided.

Savings in capital costs result from the omission of the previous dryer, including connecting lines, of the auxiliary steam boiler, including secondary installations, and/or of additional start-up devices for early compressed steam supply from the cold reheating and thus from the boiler, etc. The offsetting costs for nitrogen supply are markedly lower and substantially include the nitrogen receiver or pipes and valves for nitrogen supply or for discharging nitrogen into the open air.

If a nitrogen production plant is present on-site, added thereto are a sufficiently dimensioned compressed air generation plant and advantageously a nitrogen collection area, which receives the nitrogen-containing exhaust air and makes it available to the compressed air generation unit as feed air.

At least, however, synergistic effects are achieved in relation to the preservation of other parts of the steam circuit. Although these savings are offset by the operational costs for nitrogen consumption and in particular for compressed air generation, these are comparatively low Further synergistic effects are achieved if a works air plant is installed, in relation to the compressed air system required on-site for nitrogen production.

Furthermore, savings in fuel may be achieved due to significantly faster cold starts, since the waiting time to chemical steam purity may in principle be dispensed with. A prerequisite therefor, however, is that other parts of the water-steam circuit have also been adequately preserved and equipped to counter the penetration of ambient air and operated accordingly.

Compared with a plant which is operated with a fossil fuel-fired auxiliary boiler, an emission source to be taken into account in the case of approval would also be dispensed with.

BRIEF DESCRIPTION OF THE DRAWINGS

The invention is explained in greater detail by way of example with reference to the drawings, in which, schematically and not to scale.

DETAILED DESCRIPTION OF INVENTION

Figure 1:
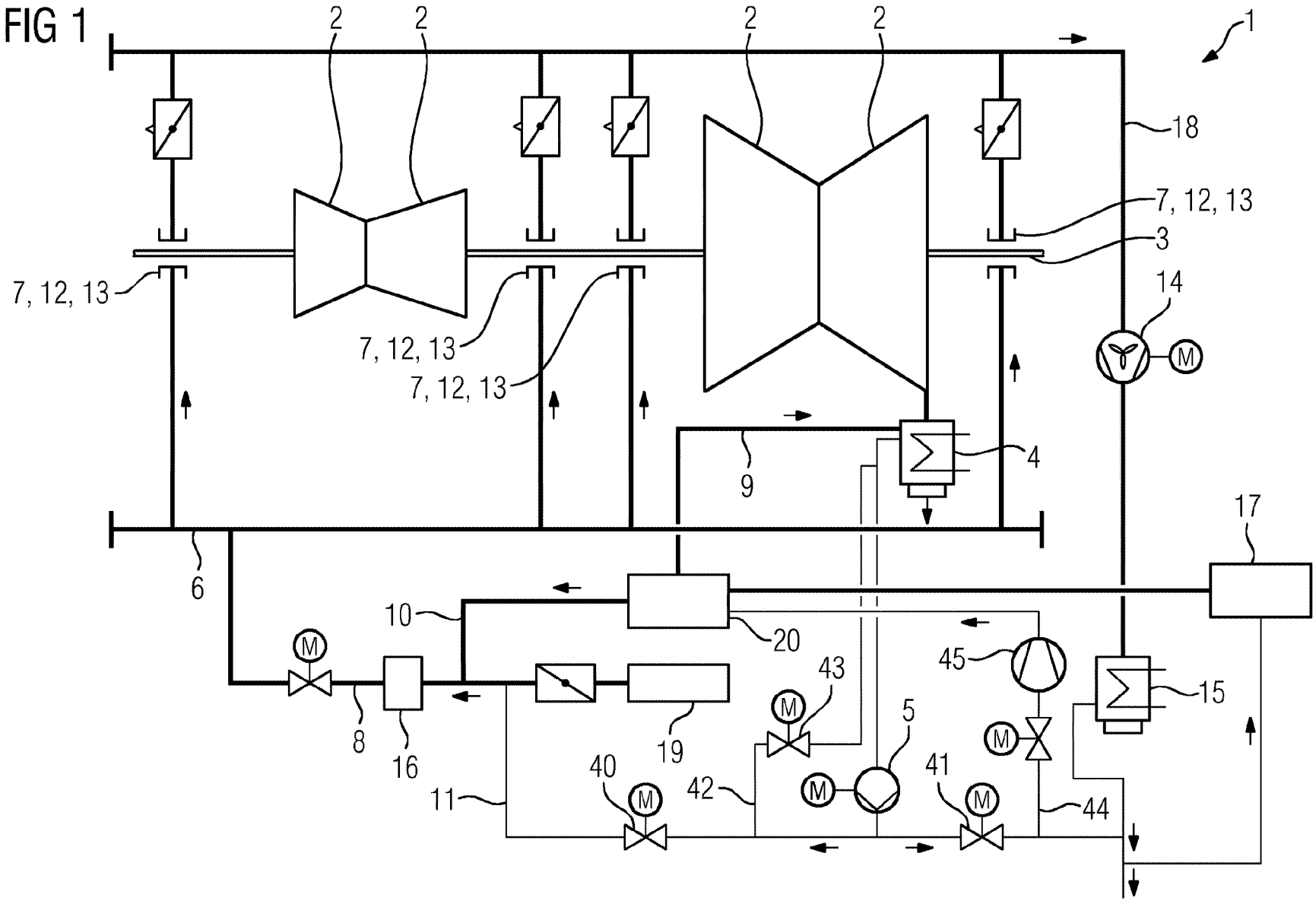
FIG. 1 shows a power plant according to the invention.

FIG. 1 is a schematic diagram which shows by way of example a power plant 1 comprising a steam turbine 2 with a shaft 3, a condenser 4 connected downstream of the steam turbine 2 in the direction of steam flow and a vacuum pump 5 connected downstream of the condenser 4. To seal off the shaft 3, use is conventionally made of a compressed steam system 6 with a compressed steam supply line 8 leading into the shaft seals 7. The shaft seals 7 comprise sealing steam chambers 12 and exhaust steam chambers 13. The compressed steam supply line 8 coming from the auxiliary steam generator 19 leads into the sealing steam chambers 12. To superheat the auxiliary steam or compressed steam, an electrical superheater 16 is connected into the compressed steam supply line 8. Within an exhaust steam system 18, the exhaust steam chambers 13 are connected with an exhaust steam fan 14, for drawing off air penetrating into the shaft seals 7 and a sub-stream of the steam from the sealing steam chambers 12. The drawn off exhaust steam is fed to an exhaust steam condenser 15.

According to the invention, a first nitrogen line 9 leads into the condenser 4. A second nitrogen line 10 leads upstream of the electrical superheater 16 into the compressed steam supply line 8. In addition, a recirculation line 11 branching off from the vacuum pump 5 leads into the compressed steam supply line 8. The recirculated quantity of nitrogen may be adjusted via a valve 40 in the recirculation line 11. Pressure control of the vacuum pump 5 may also proceed via valve 41 or via the two valves 40 and 41 combined. In the exemplary embodiment of FIG. 1, nitrogen supply proceeds via a nitrogen generator and a nitrogen reservoir 20. Since, with regard to the delivered volumetric flow rate, the vacuum pump 5 is not expected to be designed for the recirculation of nitrogen for the purposes of preservation and tends to be oversized for this purpose, FIG. 1 shows two further measures with which operation with the vacuum pump 5 is nonetheless sensibly possible. On the one hand, excess pumped nitrogen may be returned to the inlet of the vacuum pump 5 via the return line 42 with valve 43, and on the other hand nitrogen may be delivered directly into the nitrogen reservoir 20 via line 44 with compressor 45.

Figure 2:
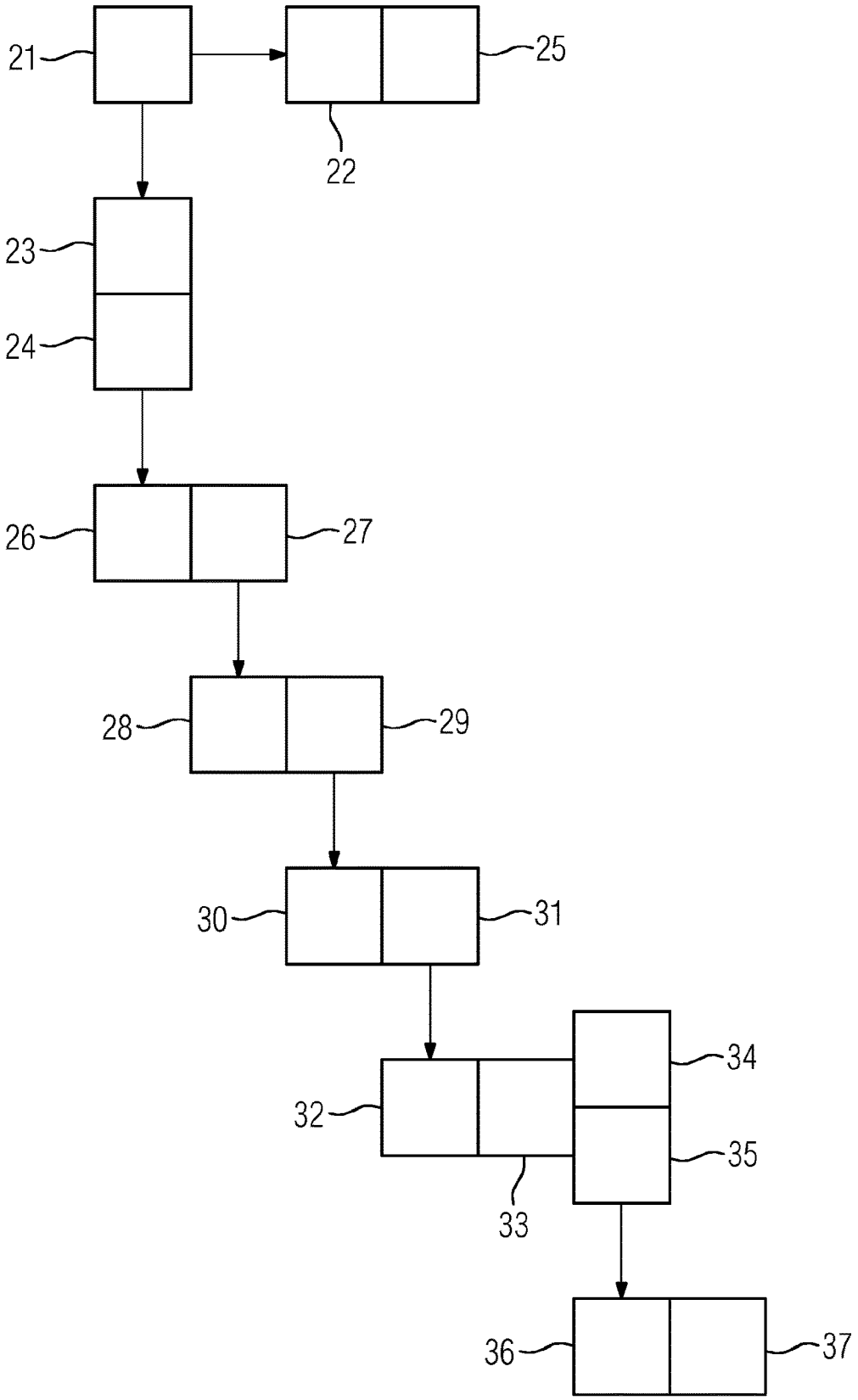
FIG. 2 shows the operational sequence of a method for preserving a power plant.

In the method according to the invention for preserving a power plant 1, according to FIG. 2 on shutdown of the steam turbine 2 into a preserved state nitrogen is introduced 21 upstream of an electrical superheater 16 into the compressed steam supply line 8 of the compressed steam system 6 and into the condenser 4. While the steam turbine 2 is still synchronized with the grid, the condenser pressure may only be raised to a limited degree by the supply of nitrogen, in order to avoid ventilation problems at the steam turbine 2. In the event both of shutdown and start-up of the steam turbine 2, nitrogen may for a time be fed 22 jointly with steam into the compressed steam supply line 8, but in particular only when the vacuum can be broken. Only after separation from the grid and achievement of the turning speed is the vacuum pump 5 switched off 23. A corresponding condenser-side shut-off at the condenser air extraction is closed. The vacuum breaker is not used (it may optionally be wholly dispensed with if it is replaced by a sufficiently large nitrogen feed-in at the condenser). The pressure in the condenser 4/steam turbine 2 is then raised to overpressure 24 via nitrogen supply.

In the compressed steam system an overpressure is always maintained 25 (either by nitrogen feed-in, conventional compressed steam supply from the boiler or a combination of the two) during the nitrogen filling operation (this may begin slowly as early as during shutdown of the power plant, i.e. steam turbo set still synchronized with the grid), such that no ambient air can penetrate via this path. It may thus be ensured that from a chemical standpoint the plant is already ready for a rapid start (no waiting for steam purity) and corrosion is stopped in the region of steam turbine and condenser even in the event of a full condensate collection tank.

After complete shutdown of the steam turbine 2 and once a nitrogen overpressure has been achieved in the steam turbine 2 and in the condenser 4, the nitrogen supply of the compressed steam system 6 is taken out of operation 26 during the preservation phase. The exhaust steam system 18 is in operation at least for a time during deliberate filling of the condenser and the steam turbine with nitrogen.

Nitrogen-enriched exhaust air from the exhaust steam chambers 13 may be compressed and made available 28 as input air to a nitrogen generator 17. For preservation during the shutdown procedure for the steam turbine 2 and while it is out of service, a comparatively small, first quantity of high purity nitrogen is needed 29.

Heating or keeping warm of the steam turbine 2 is assisted 30 by heating of the nitrogen via an electrical superheater 16 arranged in the compressed steam supply line 8.

Prior to an expected temperature change in the steam turbine 2 or in the condenser 4, a nitrogen pressure in the steam turbine 2 or in the condenser 4 is increased 31.

On start-up of the power plant 1, in particular during condenser evacuation, nitrogen is backfed 32 continuously via the compressed steam system 6 to seal the steam turbine shaft seal, as long as sufficient compressed steam is not present.

On start-up of the steam turbine 2, the vacuum pump 5 is brought back into operation 33. In particular, a vacuum sufficient for opening the steam diverting stations or enabling start of the gas turbine is generated via the vacuum pumps. Nitrogen is discharged 34 overhead via a corresponding exhaust air line at the vacuum pumps or, in the case of on-site nitrogen production (e.g. by means of pressure swing adsorption), is fed to a special feed air area in a compressed air generation plant for nitrogen production 35. It is thus sensible to recompress the heavily nitrogen-containing exhaust gas from the exhaust steam system 18 or the exhaust air from the vacuum pump 5 and make it available to the nitrogen generator 17 as compressed input air. In this way, the nitrogen production plant and the "compressed air quantity" needed therefor may be much smaller.

The nitrogen required may either proceed via an externally fillable receiver (for example set of cylinders) or nitrogen is produced on-site (for example by means of pressure swing adsorption) and optionally kept ready in a receiver. The size of the receiver and/or of the nitrogen production plant must be sufficient to ensure at least filling of the steam turbine/condenser and subsequent pressure maintenance. Furthermore, the renewed start-up system must also be taken into consideration, i.e. it is necessary to consider from when nitrogen backfeed may be replaced again by conventional compressed steam. If nitrogen production does not take place on-site, delivery logistics must be taken into consideration when determining the size of the receiver.

To limit nitrogen requirements, during start-up nitrogen is branched off at least for a time at the exhaust air of the vacuum pump 5 and fed 36 to the compressed steam system 6. The nitrogen is naturally not recirculated into the compressed steam system 6 immediately, but rather only after a given operating time, specifically once air in a recirculation line 11 from the condenser 4 to the compressed steam system 6 has been expelled and once a sufficiently reduced pressure has been achieved in the condenser 4 which enables opening of steam diverting stations. This is ensured by corresponding shut-off devices.

In the case of nitrogen production on-site, the capacity of a given nitrogen plant may be varied by varying the degree of nitrogen purity. As has already been described above, the provision of a smaller but high purity nitrogen quantity is necessary for preservation.

This is required during the shutdown procedure and the out-of-service period and results from the comparatively low nitrogen losses via the exhaust steam system, since the nitrogen overpressure in steam turbine/condenser is kept very low for preservation purposes. Nitrogen production could then be changed over for start-up from "high purity" in the case of preservation such that a comparatively larger, second quantity of less pure nitrogen is provided 37. The provision of a larger quantity of less pure nitrogen for start-up is necessary in relation to quantity and sufficient with regard to purity. Nitrogen has namely to be provided with a higher pressure in the compressed steam system 6, whereby the nitrogen losses via the exhaust steam system 18 increase. On the other hand, the increased impurity is not a problem due to the start-up operation being short, and furthermore high purity nitrogen is also recirculated via the vacuum pump 5.

With regard to operational safety, it should be noted that the exhaust steam system 18 (in particular the extraction fans) remains in operation for the entire time (even during the optionally extended out-of-service preservation) and the nitrogen, otherwise escaping into the power house via the shaft seals 7, is removed overhead via a corresponding pipe or fed to a particular (correspondingly well shielded) feed air region in an optionally additional compressed air generation plant intended merely to compress the nitrogen-containing exhaust air. The power house ventilation present ensures, as a further safety measure, that any nitrogen accumulations (e.g. in the event of malfunctioning of the extractor fans at the exhaust steam system 18), which could stop sufficient oxygen supply for people, cannot arise in the first place. As a further safety measure, corresponding alarm installations, which indicate that the exhaust steam system 18 and/or the building ventilation have failed, and moreover corresponding gas detectors may be applied, which detect and accordingly clearly indicate either a high nitrogen concentration or a low oxygen concentration. To this end, stationary gas detectors or indeed those worn by individual employees may be used. Thus, any problems arising in relation to personal safety may be very well managed. Overall, it should also be noted that the molecular nitrogen given off in gaseous form is non-toxic in itself and, as the main constituent of air, also not an environmentally relevant emission.

The invention claimed is:

1. A power plant comprising:

a steam turbine with a shaft, a condenser connected downstream of the steam turbine in the direction of steam flow, a vacuum pump connected downstream of the condenser, a compressed steam system with shaft seals and a compressed steam supply line leading into the shaft seals, a first nitrogen line which leads into the condenser, and a second nitrogen line and a recirculation line branching off from the vacuum pump which lead into the compressed steam supply line.

2. The power plant as claimed in claim 1, wherein the shaft seals comprise sealing steam chambers and exhaust steam chambers, and wherein the compressed steam supply line leads into the sealing steam chambers and the exhaust steam chambers are connected with an exhaust steam fan for drawing off air penetrating into the shaft seals and a sub-stream of the steam from the sealing steam chambers and feeding then to an exhaust steam condenser.

3. The power plant as claimed in claim 1, wherein an electrical superheater is connected into the compressed steam supply line and the first nitrogen line leads into the compressed steam supply line upstream of the electrical superheater.

4. A method for preserving a power plant comprising a steam turbine, a condenser connected downstream of the steam turbine, a vacuum pump connected downstream of the condenser and a compressed steam system, the method comprising:

on shutdown of the steam turbine into a preserved state, feeding nitrogen into the compressed steam system and into the condenser, and bringing the steam turbine and the condenser to nitrogen overpressure and switching off the vacuum pump, and on start-up of the steam turbine, bringing the vacuum pump back into operation and branching off nitrogen at least for a time at the exhaust air of the vacuum pump and feeding the nitrogen to the compressed steam system.

5. The method as claimed in claim 4, wherein the nitrogen is fed into a compressed steam supply line of the compressed steam system upstream of an electrical superheater.

6. The method as claimed in claim 4, wherein on shutdown of the power plant the nitrogen is fed jointly with steam into the compressed steam supply line as soon as it is possible to break the vacuum.

7. The method as claimed in claim 4, wherein, after shutdown of the steam turbine, once a nitrogen overpressure has been reached in the steam turbine and in the condenser, the nitrogen supply of the compressed steam system is taken out of operation during the preserved state.

8. The method as claimed in claim 4, wherein a nitrogen pressure is increased in the steam turbine or in the condenser prior to an expected temperature change in the steam turbine or in the condenser.

9. The method as claimed in claim 4, wherein, on start-up of the power plant, as long as sufficient compressed steam is not present, the nitrogen is backfed continuously via the compressed steam system.

10. The method as claimed in claim 4, wherein the nitrogen from the condenser is recirculated into the compressed steam system for start-up of the power plant, once air in a recirculation line from the condenser to the compressed steam system has been expelled and once a sufficiently reduced pressure has been achieved in the condenser to allow steam diverting stations to be opened.

11. The method as claimed in claim 4, wherein heating or keeping warm of the steam turbine is assisted by heating of the nitrogen via an electrical superheater arranged in the compressed steam supply line.

12. The method as claimed in claim 4, wherein nitrogen-enriched exhaust air from exhaust steam chambers is compressed and made available as input air to a nitrogen generator.

13. The method as claimed in claim 4, wherein a comparatively small, first quantity of high purity nitrogen is provided for preservation during the shutdown for the steam turbine and while it is out of service and a comparatively larger, second quantity of less pure nitrogen is provided per unit time for start-up.

14. The method as claimed in claim 4, wherein an exhaust steam system is in operation at least for a time during deliberate filling of the condenser and the steam turbine with nitrogen.

* * * * *